US008778497B2

(12) United States Patent
Smith et al.

(10) Patent No.: US 8,778,497 B2
(45) Date of Patent: Jul. 15, 2014

(54) UNDERLAYMENT MAT EMPLOYED WITH A SINGLE-PLY ROOFING SYSTEM

(75) Inventors: Ralph Berryman Smith, Purvis, MS (US); Donald Otis McCleskey, Hattiesburg, MS (US); Norman F. Manning, Hendersonville, TN (US); L. Ralph Smith, Brookhaven, MS (US)

(73) Assignee: L&P Property Management Company, South Gate, CA (US)

( * ) Notice: Subject to any disclaimer, the term of this patent is extended or adjusted under 35 U.S.C. 154(b) by 1277 days.

(21) Appl. No.: 10/418,661

(22) Filed: Apr. 17, 2003

(65) Prior Publication Data

US 2003/0209305 A1 Nov. 13, 2003

Related U.S. Application Data

(60) Division of application No. 10/085,814, filed on Feb. 28, 2002, now abandoned, which is a continuation of application No. 09/083,654, filed on May 23, 1998, now abandoned.

(51) Int. Cl.

| | |
|---|---|
| ***B32B 9/04*** | (2006.01) |
| ***E04B 2/00*** | (2006.01) |
| ***E04D 11/02*** | (2006.01) |
| ***E04D 12/00*** | (2006.01) |

(52) U.S. Cl.

CPC ..... *E04D 11/02* (2013.01); *E04D 12/002* (2013.01)

USPC ..... 428/411.1; 156/71

(58) Field of Classification Search

USPC ..... 428/40.1, 40.2, 143, 144, 147, 489; 52/408, 409, 746.11, 746.1, 741.1, 52/309.1, 309.13

See application file for complete search history.

(56) References Cited

U.S. PATENT DOCUMENTS 1,902,298 A 3/1933 Avery et al.
3,307,989 A * 3/1967 Harshberger ..... 156/71

(Continued)

FOREIGN PATENT DOCUMENTS

AU 637565 * 5/1993

OTHER PUBLICATIONS

Merriam-Webster Dictionary definition of the term "substantial" (copyright 2013).*

(Continued)

*Primary Examiner* — David Sample
*Assistant Examiner* — Nicole T Gugliotta
(74) *Attorney, Agent, or Firm* — Michael Best & Friedrich LLP

(57) ABSTRACT

An underlayment mat for single ply roof membranes which provides the following: insulation, separate the roof membrane from incompatible materials in the substrate, protect the roof membrane from puncture or undue wear from irregular surfaces on the substrate, provide adequate support while being flexible enough to work with the single ply membrane to absorb shock and, or provide a continuous, flat upper surface on which a roof covering is applied. The underlayment member may be woven or unwoven, it may be spun bound or needled punched or constructed by whatever method best achieves the desired physical characteristics herein described at the most economical cost. Further, this mat may be made of the following materials including but not limited to and either individually or combined: Various synthetic fibers, acrylic, rayon, nylon, polyester, foam or foam scraps, and or mineral fibers such as glass, carbon, mineral wool, ceramic, and slag wood fibers. These materials being made of either new raw materials and/or from recycled materials and selected for their hydrophobic properties. The underlayment is lightweight, pliable, cuttable, flexible, resilient, and maneuverable. This underlayment mat may be made in rolls of various lengths and widths to facilitate optimum handling on the roof top. The underlayment mat is perpetually recyclable. An underlayment as just described.

22 Claims, 4 Drawing Sheets

(56) References Cited

U.S. PATENT DOCUMENTS

| | | | | | |
|---|---|---|---|---|---|
| 4,186,236 | A | | 1/1980 | Heitmann | 428/291 |
| 4,248,926 | A | * | 2/1981 | Tajima et al. | 442/90 |
| 4,291,086 | A | * | 9/1981 | Auten | 442/29 |
| 4,390,585 | A | * | 6/1983 | Holden | 428/172 |
| 4,393,634 | A | | 7/1983 | McDermott et al. | 52/309.1 |
| 4,424,650 | A | * | 1/1984 | Van Note | 52/96 |
| 4,441,295 | A | * | 4/1984 | Kelly | 52/408 |
| 4,512,806 | A | * | 4/1985 | Graham | 106/18.24 |
| 4,529,625 | A | | 7/1985 | Reidenbach et al. | 427/186 |
| 4,545,847 | A | * | 10/1985 | Schneller | 156/579 |
| 4,595,636 | A | * | 6/1986 | Wiercinski et al. | 428/489 |
| 4,669,246 | A | | 6/1987 | Freeman | 52/408 |
| 4,751,122 | A | | 6/1988 | May | 428/41 |
| 4,803,111 | A | * | 2/1989 | Mansell | 428/139 |
| 4,873,303 | A | * | 10/1989 | Blackwood et al. | 427/365 |
| 4,965,977 | A | * | 10/1990 | White | 52/410 |
| 4,992,315 | A | | 2/1991 | Zickell | 428/41 |
| 4,996,812 | A | * | 3/1991 | Venable | 52/408 |
| H0000982 | H | * | 11/1991 | Berggren et al. | 156/275.1 |
| 5,142,837 | A | * | 9/1992 | Simpson et al. | 52/409 |
| 5,220,762 | A | * | 6/1993 | Lehnert | 52/408 |
| 5,246,760 | A | | 9/1993 | Krickl | 428/113 |
| 5,272,000 | A | | 12/1993 | Chenoweth et al. | 428/283 |
| 5,318,844 | A | | 6/1994 | Brandon | 428/357 |
| 5,415,511 | A | * | 5/1995 | Damron | 411/480 |
| 5,458,960 | A | | 10/1995 | Neiminen et al. | 428/284 |
| 5,578,315 | A | | 11/1996 | Chien et al. | 424/435 |
| 6,055,786 | A | * | 5/2000 | Hubbard et al. | 52/409 |
| 6,177,024 | B1 | * | 1/2001 | Sandoval et al. | 252/62 |
| 6,308,482 | B1 | * | 10/2001 | Strait | 52/408 |

OTHER PUBLICATIONS www.duro-last.com/specbook/1%20introduction/introduction.pdf.
www.rci-mercury.com/files/ab071620.pdf.
http://131.251.21.249/local/construct/PerformanceOfRoofingSystems.htm.
http://www.buildings.com/newsletters/roofing/2004/nov04.asp.
Declaration of Rodney B. Carroll, Apr. 30, 2002.
Declaration of Ralph Berryman Smith and Donald Otis McCleskey, Feb. 27, 2002.
U.S. Appl. No. 08/711,969, Smith et al., filed Sep. 10, 1996.

* cited by examiner

UNDERLAYMENT MAT EMPLOYED WITH A SINGLE-PLY ROOFING SYSTEM

CROSS REFERENCE TO RELATED APPLICATIONS

This is a divisional application of U.S. patent application Ser. No. 10/085,814, filed Feb. 28, 2002 now abandoned; which is a continuation of U.S. patent application Ser. No. 09/083,654, filed May 23, 1998 now abandoned, hereby incorporated by reference in their entirety.

BACKGROUND OF THE INVENTION

1. Field of the Invention

The present invention relates to a mat, the purpose of which is as an underlayment for single-ply roofing membranes. Said mat may be woven or non-woven, spun bound or needle punched or constructed by whatever method best achieves the desired physical characteristics herein described at the most economical cost.

Further, this mat may be made of the following materials including but not limited to and either individually or combined: Various synthetic fibers; acrylic, rayon, nylon, polyester, foam, foam scraps, and or mineral fibers such as ceramic, glass, mineral wool, carbon, and slag wool fibers. These materials being made of either new raw materials and or from recycled materials may be selected for their hydrophobic properties. Further, this mat may be formed into rolls of various widths and lengths to facilitate handling on the roof and thus reduce labor.

2. Description of the Prior Art

Roofing systems are well known, particularly, a roof deck which supports several layers of materials forming a finished waterproof roof surface over an enclosed space.

In commercial structures and other relatively flat roof structures, various materials are known and used in combinations for constructing a finished roof system. Generally, purpose is to provide one or more of the following critical functions as needed: separate the roofing material from incompatible materials in the substrate, providing insulation value, protect the roofing material from puncture or undue wear from irregular surfaces on the substrate, provide adequate support, and or provide a continuous, flat upper surface on which a roof membrane is applied.

In addition, existing roof systems are covered with a layer or layers of board stock insulation or the like. The purpose of the board stock insulation is often not to provide insulation but to act as a separator between the substrate and the new roof systems being installed.

In the roofing industry and with single ply roofs in particular, all accessory must be approved by the roof membrane manufacturer and as such are not just well known but a matter of record. The single ply prior art uses rigid uses rigid board stock materials as underlayment for the roof membrane exclusively. (Single ply refers to roof systems using a single sheet of waterproof material such as EPDM (synthetic rubber), PVC (polyvinyl chloride), or CPE (chlorinated polyethylene) to form the roofing as opposed to the built-up industry which uses multiple plies of asphalt felts or the like to form the roof membrane. Further asphalt is incompatible with single ply materials.)

Conventional board stock materials are well known in the roofing industry and their numerous inherit drawbacks have been accepted as part of the job since no other method or material has been made available. Some of the drawbacks of conventional board stock materials are: most are heavy and all are bulky, the largest available is 4'×8' which covers only 32 sq. ft., thus, it takes an army of men to transport and install them. Most rigid board stock materials will warp, shrink or swell and therefore must be secured in place with an average of one screw and plate per 4 sq. ft. Or mopped down with asphalt or special adhesive. They are rigid, and thus easily damaged in installation, storage, or handling. The edges and corners will turn up or break off. They are difficult to fit together and nearly impossible to cut and fit around roof penetrations, such as vents, pipes, ducts, etc. Most board stock materials are impossible to cut with a knife and must be cut with a power saw. A pattern of continuous joints is inherit in rigid board insulation applications. These joints impart mechanical stress to the roof membrane. Some require that the joints be taped and all require that any gaps over ¼" be filled with similar material. The handling and cutting of board stock materials creates a good deal of job site debris and also a dust like material which makes breathing difficult. Most board stock insulations are sensitive to moisture and if exposed will deteriorate, warp or delaminate and must be disposed of. Some rigid board insulations contain HCFC'c, CFC's, or other materials which either harm humans or the environment. When it comes time to re-roof, rigid boards must be removed and disposed of in landfills. Most rigid board stock materials being rigid, do not have the flexibility to absorb impact and thus the roof membrane must absorb the entire shock and thus the single ply membrane becomes punctured. These and other problems inherit to rigid board stock insulation materials are accepted by the roofing industry since there is no other material offered which will perform the functions required of an underlayment.

The prior-art illustrates an abundance of roofing systems particularly the single ply system which typically specify the use of rigid woodfiber board stock material or other rigid board stock insulation exclusively as underlayment.

U.S. Pat. No. 4,529,625, issued Jul. 16, 1985 to Reidenbach et al., discloses a fibrous sheet having one surface coated with asphalt as a method of making a roofing membrane.

U.S. Pat. No. 5,272,000, issued Dec. 21, 1993 to Chenoweth et al., discloses the method to manufacture a multi-layered, resiliently rigid nonwoven matrix of glass, synthetic and natural fibers into a blanket with good strength and insulating characteristics.

U.S. Pat. No. 5,246,760, issued Sep. 21, 1993 to Krickl discloses a multi-layered, batt consisting of sheepswool as a superior insulating element.

U.S. Pat. No. 5,458,960 issued Oct. 17, 1995 to Neiminen et al., discloses the materials needed and the method to manufacture a layered flexible base web having superior strength and insulation properties to be used as a construction covering.

U.S. Pat. No. 4,393,634 issued Jul. 19, 1983 to McDermott et al., discloses a roofing system made of an asphalt emulsion impregnated needle punched synthetic fabric.

U.S. Pat. No. 4,996,812 issued Mar. 5, 1991 to Venable discloses a method of attachment using a layer of adhesive to fully adhere the fleece backed waterproof membrane to the structure.

None of the above inventions and patents, taken either singly or in combination, is seen to describe the instant invention as claimed.

SUMMARY OF INVENTION

Accordingly, it is a principal object of the invention to replace the conventional board stock insulation or the like in a single ply roofing system with a mat which will meet the requirements for a single ply underlayment. This mat may be woven, non-woven, spunbound, needle punched or constructed by whatever method best produces the physical characteristic herein described. Said mat is similar to the type of mat commonly used in, but not limited to mattress construction, furniture padding, carpet underlayment, and sound and fire proofing in vehicles.

It is another object of the invention to provide an underlayment for a single ply roofing system that can be formed into rolls of various sizes for optimum handling, is pliable, lightweight, flexible, maneuverable, and is easily cuttable to allow more accurate fitting around roof penetrations which saves time, lowers labor, reduces job site debris and eliminates the health risk of breathing the dust generated when cutting boards.

It is a further object of the invention to provide an underlayment for a single ply roofing system that provides adequate support for the roofing membrane yet is flexible enough to assist the roofing membrane in absorbing impact while also being resilient and thus reduce membrane failure due to puncture.

It is a further object of the invention to provide an underlayment for a single ply roofing system that is highly resistant to damage during shipping, storage, handling, and installation and thus reduce or eliminate waste.

It is a further object of the invention to provide an underlayment for a single ply roofing system that is impervious to moisture, will not deteriorate or delaminate, and is dimensionally stable, will not warp, shrink or swell and thus, not pass mechanical stress to the roofing system.

It is a further object of the invention to provide an underlayment for a single ply roofing system that is dimensionally stable and will therefore eliminate the mechanical stress inherit at joints in rigid boards and the need to tape the joints as well as reduce the number of mechanical fasteners needed to secure rigid boards.

It is a further object of the invention to provide an underlayment for a single ply roofing system that can be installed in compression at joints thus eliminating the possibility of gaps in the joints and the need to fill said gaps.

It is a further object of the invention to provide an underpayment for a single ply roofing system that does not contain nor use any hazardous materials during manufacture and can be made of recycled material which can be recycled.

Still another object of the invention to provide an underlayment for a single ply roofing system that is easy to handle with selectable thicknesses and densities for various applications.

It is a object of the invention to provide improved elements and arrangements thereof in an apparatus for the purposes described which is inexpensive, dependable and fully effective in accomplishing its intended purposes.

These and other objects of the present invention will become readily apparent upon further review of the following specifications and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
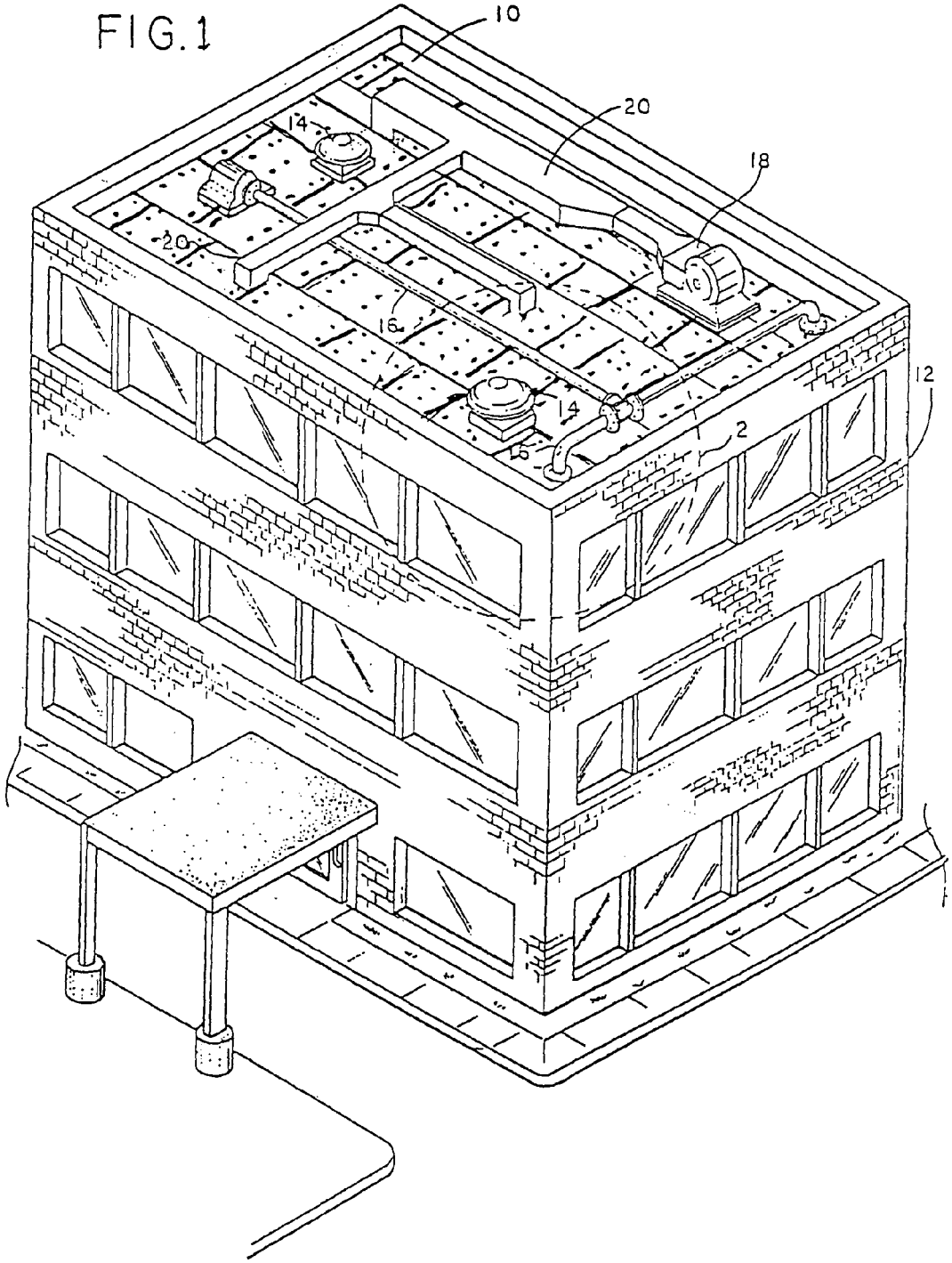
FIG. 1 is a perspective view of a roof where the present invention is typically used.

The present invention improves over the prior art as shown in the drawings. Referring to FIG. 1, a typical roof top 10 of a commercial type building 12 is shown. This type of roof top 10 is generally flat. On this type of roof 10 are typically many roof penetrations; exhaust vents 14, piping 16, HVAC units 18, and duct work 20. The roofing underlayment mat of the present invention is easily installed around these and other roof obstacles.

Figure 2:
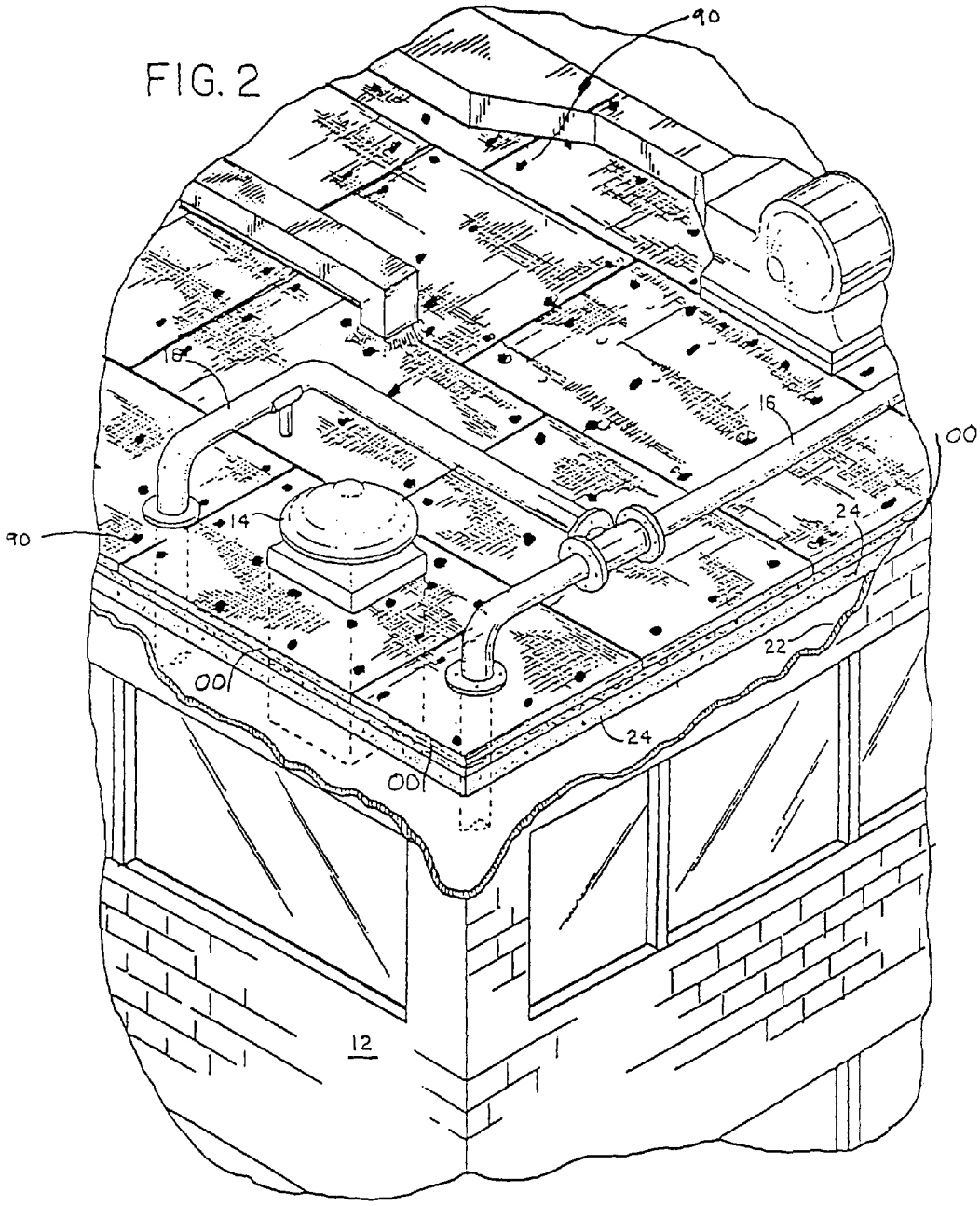
FIG. 2 is an elevational view circle 2 of FIG. 1, having a portion thereof broken away to show the prior art rigid board installed in preparation for the roof membrane.

FIG. 2 is a breakaway view of the roof shown in FIG. 1 at circle 2, a portion of the wall 22 being removed in order to show the prior art rigid board stock insulation 00 installed in preparation for the roofing membrane. Specifically, the roof top 10 contains a structural deck 24 upon which the prior art, conventional board stock insulation 00 discussed in detail hereinbefore. The rigid board stock insulation 00 is cut and fitted around the roof penetrations (e.g. 14, 16) such that it lays flat on the roof and is then secured with fasteners 90. Over the rigid board stock insulation 00 a single ply roofing membrane is installed.

Figure 3:
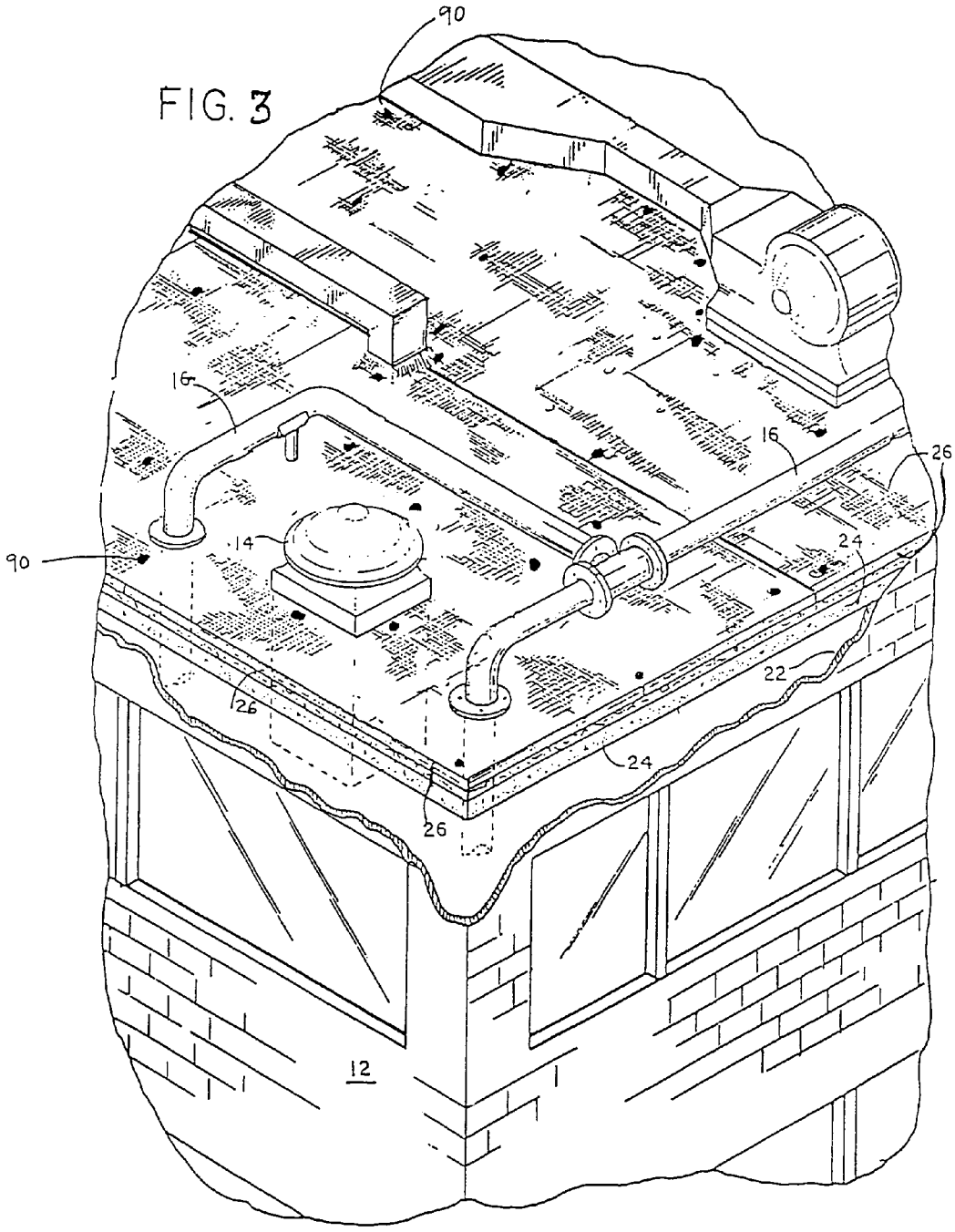
FIG. 3 is an elevational view circle 2 of FIG. 1, having a portion thereof broken away to show the instant invention underlayment mat installed in preparation for the roof membrane.

Referring to FIG. 3, is a breakaway view of the roof shown in FIG. 1 at circle 2, a portion of the wall 22 being removed in order to show the invention in use as part of a roofing system. Specifically, the roof top 10 contains a structural ceiling 24 upon which the underlayment mat 26 of this invention is laid, and this replaces the prior art, conventional board stock insulation discussed in detail hereinbefore. The underlayment mat 26 is cut and fitted around the roof penetrations (e.g. 14, 16) such that it lays flat on the roof. Over the underlayment mat 26, a single ply roofing membrane is applied.

Figure 4:
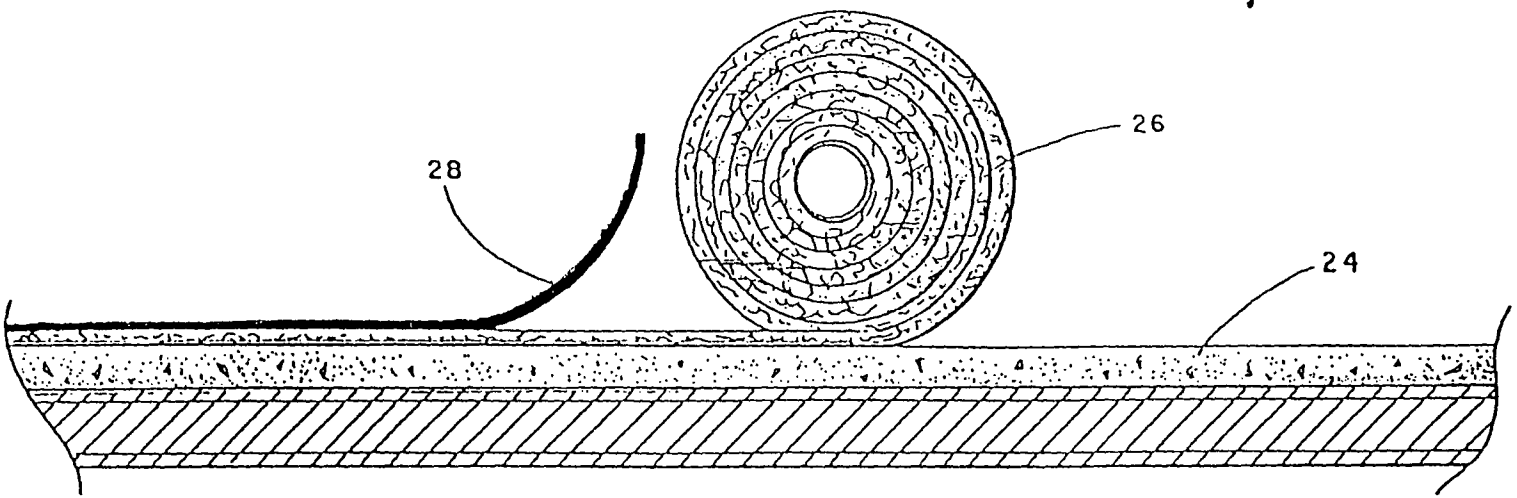
FIG. 4 is a typically installation sequence of the present invention underlayment for single ply roof membranes.

Referring to FIG. 4, a typical installation sequence is illustrated. The roof deck 24 is completed first as a structural component of the building. Over the roof deck 24, the underlayment mat 26 of the present invention is rolled out and cut as appropriate. Over the underlayment mat 26, a single ply roofing membrane 28 is finally placed into position and sealed as appropriate.

As can be seen from FIG. 3, the underlayment mat 26, has numerous advantages over the prior art materials. The primary advantage is that the mat 26 is lightweight, consequently maneuverable and manageable. This lightweight advantage also provides an average coverage area of approximately 700 sq. Ft. per roll over the prior art board stock 32 sq. Ft. per sheet. Also, it is very durable, yet pliable and easy to cut. Additionally, because the underlayment mat 26 is lightweight, it is easily handled by the roof workers in transporting the mat 26 up to and around the rooftop 10. Further, the mat 26 can vary in thickness from 1/10" to 1" depending on the roofing system requirements. The mat 26 is impervious to moisture and will not warp as the prior art board stock materials and thus requires less fasteners 90 to secure it.

It is understood that the present invention is not limited to the sole embodiment described above, but also encompasses any and all embodiments within the scope of the following claims.

The invention claimed is:

1. A roofing method comprising unrolling one or more flexible underlayment mat components onto a roof deck and placing a waterproof roofing membrane component over the one or more flexible mat components, wherein the one or more flexible mat components have an effective thickness and density for protecting the waterproof membrane from puncture by irregular surfaces on the roof deck, wherein the waterproof roofing membrane is a single ply membrane consisting of a single solid sheet of waterproof material, wherein the one or more flexible mat components separate the roof deck and the single ply membrane such that the roof deck does not contact the single ply membrane, and wherein the one or more flexible mat components cover the entire roof deck.

2. The method of claim 1 wherein the single ply membrane is selected from the group consisting of synthetic rubber, polyvinyl chloride, and chlorinated polyethylene.

3. The method of claim 1 wherein a plurality of rolled mat segments are unrolled onto the roof deck in a side by side relationship with compression at the edge joints.

4. The method of claim 1 wherein the one or more flexible mat components are cut and fitted around at least one roof penetration.

5. The method of claim 4 wherein the one or more flexible mat components are cut with a knife.

6. The method of claim 1 further comprising selecting the one or more flexible underlayment mat components to be compatible with the waterproof membrane and to effectively protect the waterproof membrane from puncture by irregular surfaces on the roof deck wherein the one or more flexible mat components comprise synthetic material and are configured for installation between the roof deck and the waterproof roofing membrane; wherein the one or more flexible mat components are of a thickness of approximately 1/10" to approximately 1"; and wherein the one or more flexible mat components weigh approximately 10 ounces to approximately 45 ounces per square yard.

7. The method of claim 6 wherein the synthetic material is compatible with the waterproof membrane such that the membrane is not damaged by contact with the one or more flexible mat components; wherein the waterproof roofing membrane is incompatible with asphalt; and wherein upon placement on the roof deck, the one or more underlayment mat components cover the entire roof deck.

8. The method of claim 6 wherein the synthetic material is comprised of hydrophobic fibers whereby the attraction, retention, or both of moisture to the one or more flexible mat components are reduced.

9. The method of claim 6 wherein the synthetic material is new material, recycled material or combinations of new and recycled materials selected from the group consisting of acrylic fibers, rayon fibers, nylon fibers, polyester fibers, foam, foam scraps, mineral fibers, ceramic fibers, glass fibers, carbon fibers, mineral wool, and slag wool.

10. The method of claim 9 wherein the synthetic material is comprised of hydrophobic fibers whereby the attraction, retention, or both of moisture to the one or more flexible mat components are reduced.

11. The method of claim 2 wherein the one or more flexible mat components are of a thickness of approximately 1/10" to approximately 1" and wherein the one or more flexible mat components weigh approximately 10 ounces to approximately 45 ounces per square yard, whereby the single ply membrane is protected from puncture by irregular surfaces on the roof deck.

12. The method of claim 6 wherein the single ply membrane is selected from the group consisting of synthetic rubber, polyvinyl chloride, and chlorinated polyethylene; and wherein a plurality of rolled mat segments are unrolled onto the roof deck in a side by side relationship with compression at the edge joints to eliminate the development of gaps at the edge joints between the unrolled mat segments.

13. The method of claim 1 wherein the one or more flexible mat components are secured to the roof deck by means of mechanical fasteners and the single ply membrane is attached to the roof deck by means of mechanical fasteners.

14. The method of claim 1 wherein the single ply membrane is attached to the one or more flexible mat components by means of an adhesive.

15. The method of claim 1 wherein the one or more flexible mat components are secured to the roof deck by means of an adhesive or mechanical fasteners and the single ply membrane is attached to said mat components by means of an adhesive or mechanical fasteners.

16. The method of claim 1 wherein the one or more flexible mat components are loose-laid and the single ply membrane is loose laid with both being held in place by means of ballast being placed on the top of the single ply membrane.

17. The roofing method of claim 1 wherein the one or more flexible mat components are non-perforated.

18. A method of protecting a waterproof roofing membrane component comprising selecting a flexible underlayment mat component comprising synthetic material that is compatible with a waterproof roofing membrane component and has an effective thickness and density for protecting the waterproof roofing membrane from puncture by irregular surfaces on a roof deck; unrolling the flexible mat component between the waterproof roofing membrane and the roof deck; and placing the waterproof roofing membrane over the flexible mat component, wherein the waterproof roofing membrane is a single ply membrane of solid waterproof sheet material, wherein the waterproof roofing membrane is applied to the flexible mat component in solid form, wherein the flexible mat component is non-perforated, wherein the flexible mat component directly contacts the roof deck, wherein the flexible mat component separates the waterproof roofing membrane from the roof deck and prevents the waterproof roofing membrane from contacting incompatible materials on the roof deck, wherein the waterproof roofing membrane is incompatible with asphalt, and wherein the flexible mat component covers the entire roof deck.

19. The method of claim 18 wherein the flexible mat component is rolled into a roll to facilitate handling and has an effective thickness and density for protecting the waterproof membrane from puncture by irregular surfaces on the roof deck, wherein the flexible mat component is of a thickness of approximately 1/10" to approximately 1", and wherein the flexible mat component weighs approximately 10 ounces to approximately 45 ounces per square yard.

20. The method of claim 18 wherein the waterproof membrane is directly adhered to the flexible mat component and the roof deck does not contact the waterproof membrane.

21. A roofing system comprising:

(a) a single ply waterproof roofing membrane component consisting of a single sheet of solid waterproof material selected from the group consisting of synthetic rubber, polyvinyl chloride, and chlorinated polyethylene; and (b) one or more flexible underlayment mat components for unrolling between a roof deck and the waterproof membrane, wherein the one or more flexible mat components (i) comprise synthetic material compatible with the waterproof membrane such that the membrane is not damaged by contact with the one or more flexible mat components, (ii) are rolled into a roll to facilitate handling, and (iii) have an effective thickness and density for protecting the waterproof membrane from puncture by irregular surfaces on the roof deck, wherein the one or more flexible mat components are of a thickness of approximately 1/10" to approximately 1" and weigh approximately 10 ounces to approximately 45 ounces per square yard, wherein the single ply waterproof roofing membrane is placed over the one or more flexible mat components and adhered indirectly to the roof deck via the one or more flexible mat components, and wherein the waterproof roofing membrane is incompatible with asphalt.

22. The roofing system of claim 21 wherein the one or more flexible mat components separate the roof deck and the single ply membrane such that the roof deck does not contact the single ply membrane, and wherein upon placement on the roof the one or more flexible mat components cover the entirety of the roof deck.

* * * * *